US006298523B1

(12) United States Patent
Stahlecker

(10) Patent No.: US 6,298,523 B1
(45) Date of Patent: Oct. 9, 2001

(54) APPARATUS FOR CONDENSING A FIBER STRAND AND A METHOD OF MAKING YARN USING SAME

(75) Inventor: Fritz Stahlecker, Josef-Neidhart-Strasse 18, 73337 Bad Ueberkingen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/710,881

(22) Filed: Nov. 14, 2000

(30) Foreign Application Priority Data

Nov. 18, 1999 (DE) ..... 199 55 525

(51) Int. Cl.[7] ..... D01H 5/86
(52) U.S. Cl. ..... 19/246; 19/150; 19/236
(58) Field of Search ..... 19/150, 236–250, 19/252, 263, 286, 287, 288, 304–308; 57/264, 304, 315, 328, 333

(56) References Cited

U.S. PATENT DOCUMENTS 5,285,624 * 2/1994 Stahlecker ..... 57/328
5,431,005 * 7/1995 Fehrer ..... 19/288
5,617,714 * 4/1997 Fehrer ..... 57/333
6,108,873 8/2000 Barauke ..... 19/236
6,158,091 * 12/2000 Olbrich et al. ..... 19/236

FOREIGN PATENT DOCUMENTS 198 46 268 10/1999 (DE) .

* cited by examiner

*Primary Examiner*—John J. Calvert
*Assistant Examiner*—Gary L. Welch
(74) *Attorney, Agent, or Firm*—Crowell & Moring LLP

(57) ABSTRACT

An apparatus for condensing a fiber strand, which travels through a condensing zone in an untwisted state after leaving a drafting unit, comprises an air-permeable transport belt, which transports the fiber strand over a sliding surface comprising a suction slit. The sliding surface is formed by means of the outer contour of a hollow body connected to a vacuum. The hollow body comprises in addition a pressurized chamber, which has in one area facing away from the suction slit at least one air outlet opening directed against the inner side of the rotating transport belt.

11 Claims, 3 Drawing Sheets

APPARATUS FOR CONDENSING A FIBER STRAND AND A METHOD OF MAKING YARN USING SAME

BACKGROUND AND SUMMARY OF THE INVENTION

This application claims the priority of 199 55 525.7, filed in Germany, Nov. 18, 1999, the disclosure of which is expressly incorporated by reference herein.

The present invention relates to an apparatus for condensing a fiber strand which travels through a condensing zone in an untwisted state after leaving a drafting unit, and in which condensing zone the fiber strand, disposed on the outside of an air-permeable, circling transport belt, is transported over a suction slit which is arranged in a stationary sliding surface which guides the inner side of the transport belt, which sliding surface is formed by means of the outer contour of a hollow body connected to a vacuum.

An apparatus for pneumatic condensing of this type is disclosed in German published patent application 198 46 268 (corresponding U.S. Pat. No. 6,108,873). For the pneumatic condensing of a fiber strand leaving a drafting unit it is important that the fiber strand is transported in the condensing zone disposed on an air-permeable transport element while still in a twist-free state and having fibers essentially disposed parallel to one another, and that in the condensing zone an air stream is generated which flows through the transport element, said air stream thus determining the degree of condensing by means of its width and/or direction and, positioning the fibers diagonally to the transport direction so that the fiber strand is bundled or condensed. In the case of such a condensed fiber strand, no spinning triangle occurs before the twist is imparted, so that the thread produced therefrom is more even, more tear resistant and less hairy In practice it has been shown that in the case of pneumatic condensing a certain amount of fiber fly occurs, which can in time block the perforations of the transport belt, which impairs the condensing effect. When the desired condensing effect does not take place, this can result in the finished cloth having a so-called Moiré effect, which can render the product a reject. It must therefore be ensured that the condensing effect is not impaired by blockage of the perforations at the individual spinning stations.

It is an object of the present invention to ensure that the perforations of the transport belt do not become blocked and that the condensing effect is not impaired.

This object has been achieved in accordance with the present invention in that the hollow body comprises a pressurized chamber, which comprises, in an area facing away from the suction slit, at least one air outlet opening directed against the inner side of the transport belt.

The air outlet opening, of which there is at least one, should be located where outcoming pressurized air is not harmful for the condensing process, that is, in an area facing away from the suction slit. A light, constant pressure is sufficient, which continuously "expels" the fiber fly. Because of the effective width of the transport belt, it is possible to arrange a plurality of air outlet openings in a row adjacent to one another.

In an advantageous embodiment of the present invention, the at least one air outlet opening runs into a hollow space, which is defined on one side by the outer contour of the hollow body and on the other side by the inner side of the transport belt. Thus the light pressure is effective over the entire effective width of the transport belt despite the presence of only one air outlet opening. In addition, because of the occurring hollow space, the fiber fly can be more easily removed from the transport belt. Fiber fly can be pressed from the inside to the outside of the transport belt and can leave the transport belt at a place which is not detrimental to the condensing process.

It is provided that in the area of the hollow space a roller of the front roller pair of the drafting unit is disposed on the outer side of the transport belt. Hereby the driven front bottom roller is advantageously used, whose rotational direction is the opposite direction to the running direction of the transport belt and thus also removes fiber fly mechanically from the outside of the transport belt. The above mentioned hollow space is hereby adapted to the contour of the disposed roller.

In further embodiments of the present invention, the hollow space is covered in running direction of the transport belt by a bordering surface, which is disposed with a scraping edge closely to the inner side of the transport belt. This prevents any air from flowing off to the condensing zone where it could be detrimental. In addition, a mechanical cleaning on the inner side of the transport belt takes place.

It has proven to be practical when the bordering surface is arranged at an extension comprising the suction slit, which extension, together with a hollow profile connected to a vacuum source, forms the hollow body. This arrangement is not only practical as regards the manufacture of the components, but also the extension can be limited to that area of the hollow body where the transport belt is guided and where wear is most likely to be expected. The extension is therefore advantageously made of ceramic.

The hollow space is connected to the atmosphere in the opposite direction to the running direction of the transport belt, so that the air can flow there where it is absolutely harmless for the spinning process, namely through the perforations of the transport belt to the outside.

These and further objects, features and advantages of the present invention will become more readily apparent from the following detailed description thereof when taken in conjunction with the accompanying drawings.

DETAILED DESCRIPTION OF THE DRAWINGS

Figure 1:
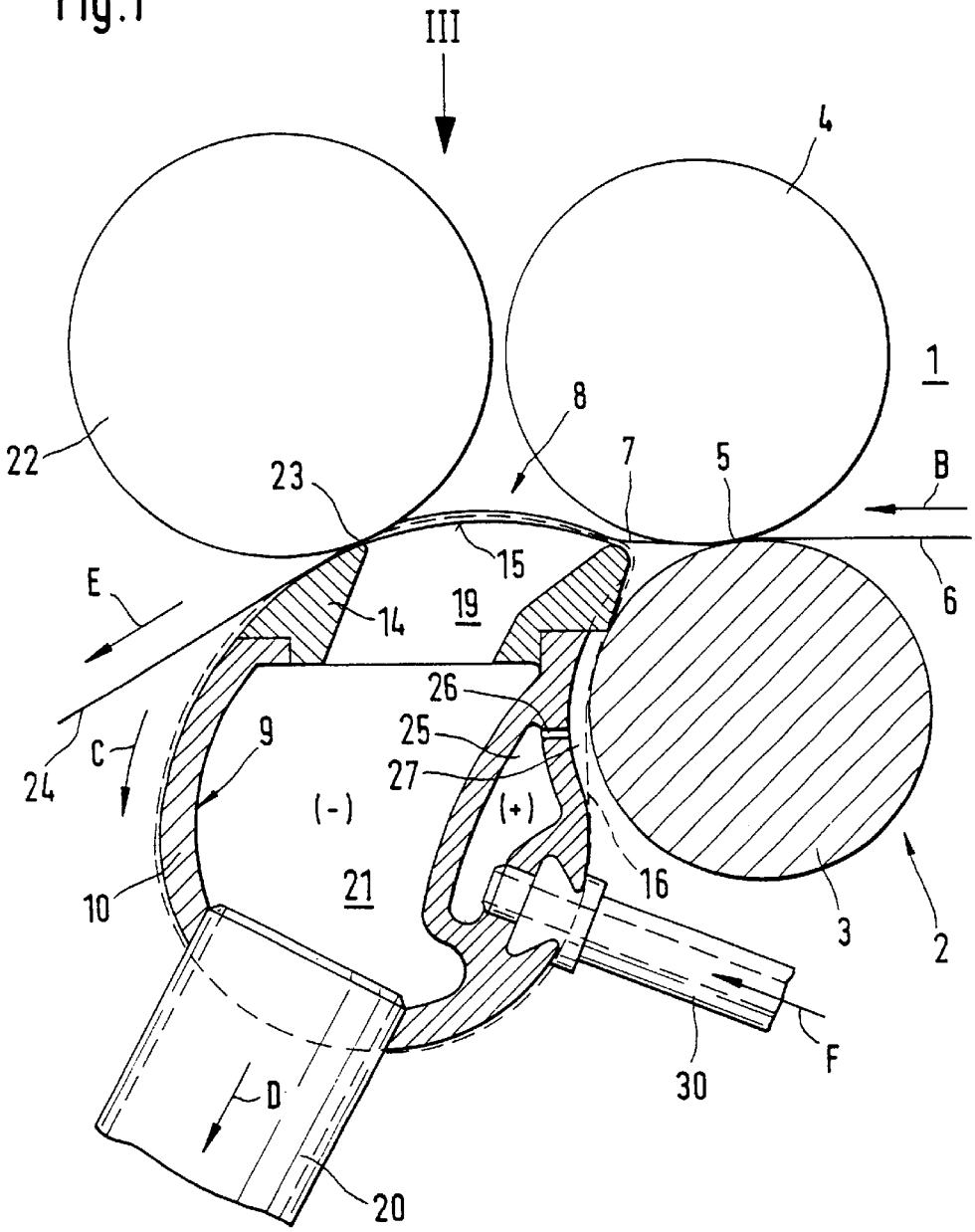
FIG. 1 is a partly sectional side view, enlarged in comparison to the actual size, of an apparatus according to the present invention.
Figure 2:
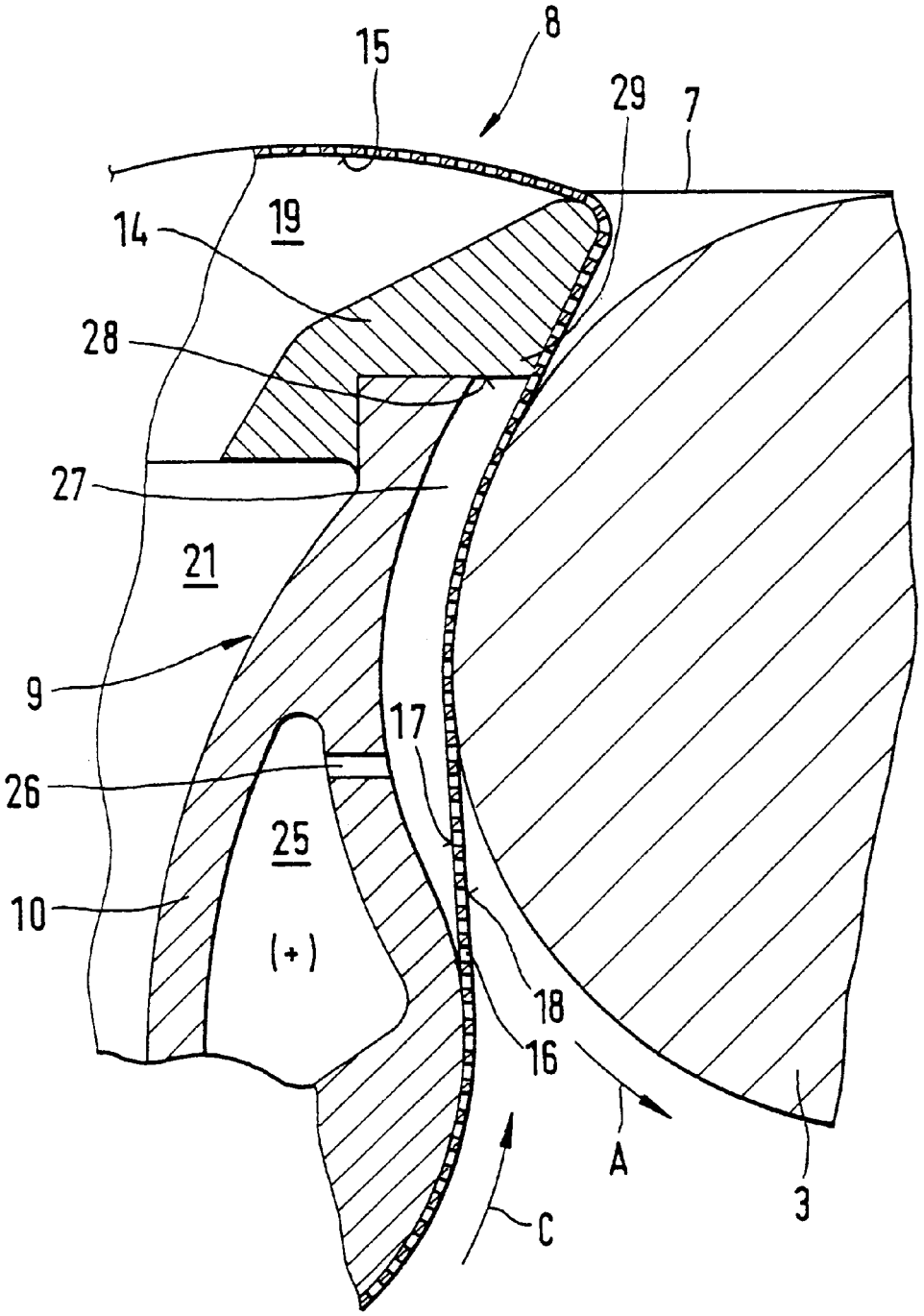
FIG. 2 is a greatly enlarged view of a portion of FIG. 1, showing an area of an air outlet opening directed against the inner side of the transport belt.
Figure 3:
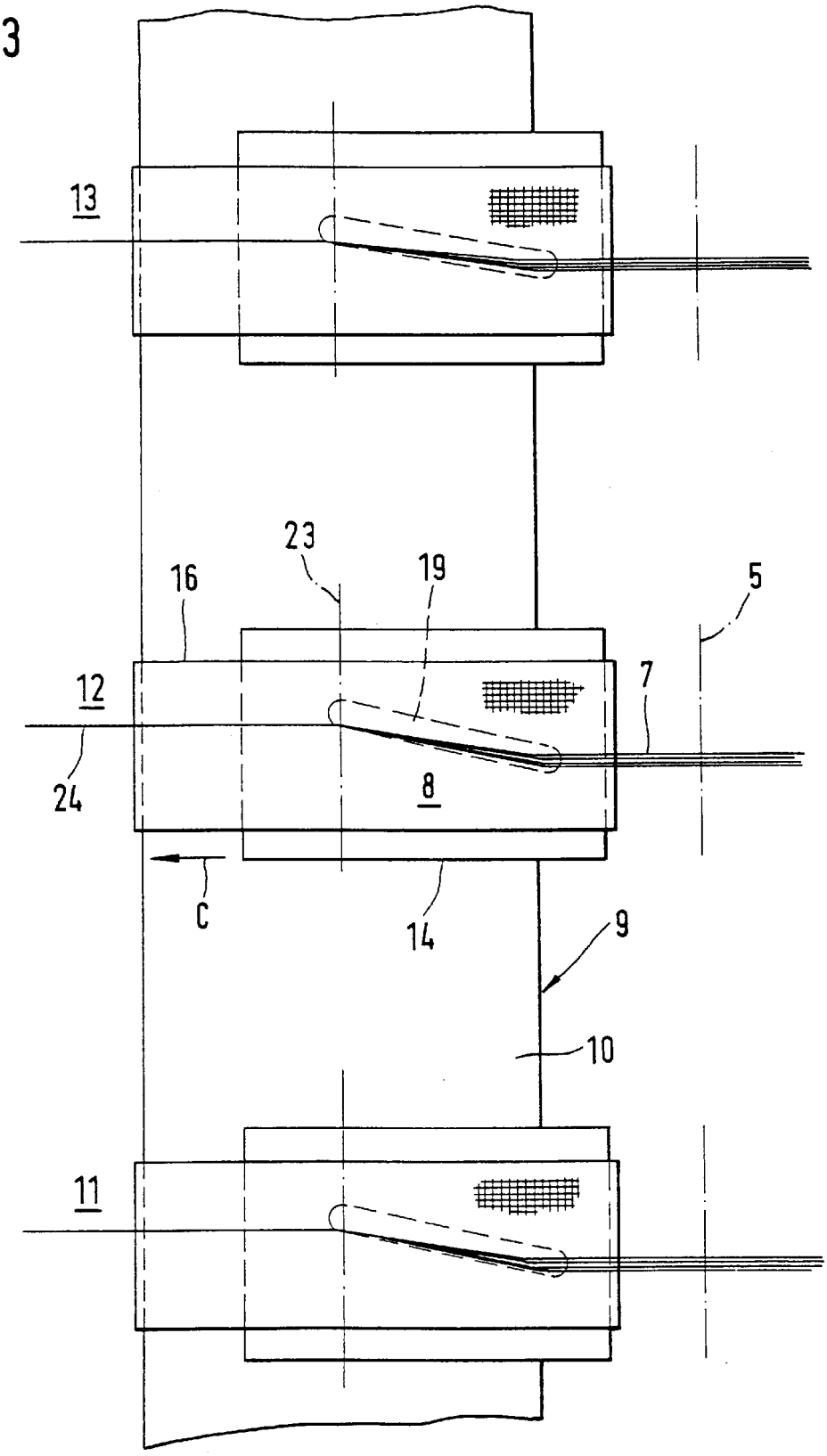
FIG. 3 is a view in the direction of the arrow III of FIG. 1 of the hollow body extending over a plurality of spinning stations.

The apparatus according to the present invention as shown in FIGS. 1 to 3 is located directly downstream of a drafting unit 1, as applied in spinning machines, in particular ring spinning machines, and of which drafting unit 1 only the front roller pair 2 is schematically represented. The front roller pair 2 comprises a driven bottom cylinder 3 extending in machine longitudinal direction, the direction of rotation of which bottom cylinder 3 is denoted by A (FIG. 2), as well as a pressure roller 4 arranged at each spinning station. The drafting zone of the drafting unit 1 ends at the front nipping line 5 of the front roller pair 2.

A sliver or roving 6 to be drafted is fed in feed direction B in the known way through the drafting unit 1 and is drafted there to the desired degree of fineness. Downstream of the front nipping line 5, a drafted, but still untwisted fiber strand 7 is present, which travels through a condensing zone 8 before the spinning twist is imparted.

The apparatus for condensing the fiber strand 7 comprises a hollow body 9 connected to a vacuum, which is preferably designed in two parts. The first part is a continuous hollow profile 10 which extends along a plurality of spinning stations 11, 12, 13 . . . , for example a machine section, the other part being an extension 14 provided for each spinning station, which extension 14 can be made of ceramics. At each spinning station 11, 12, 13, the hollow body 9, consisting of the hollow profile 10 and the extension 14 , forms with its outer contour 15 a sliding surface for an air-permeable circulating transport belt 16 running in direction C. This transport belt 16 is advantageously designed as a thin, finely perforated woven belt. As the transport belt 16 is primarily stressed in the area of the extension 14, this extension 14 is protected against wear.

The transport belt 16 is thus guided with its inner side 17 on the sliding surface in the form of the outer contour 15 of the hollow body 9 and transports the fiber strand 7 on its outer side 18 through the condensing zone 8.

In the condensing zone 8, a suction slit 19 is provided in the hollow body 9 per spinning station, which suction slit 19 extends essentially in running direction C of the transport belt 16, but advantageously slightly diagonally thereto. The length of the suction slit 19 extends to the end of the condensing zone 8, the width of the suction slit 19 is wider than the width of the condensed fiber strand 7.

The hollow body 9 is connected once per machine section by means of a vacuum connection 20 to a vacuum source (not shown), whereby the suction direction is denoted by D. The minus sign in brackets in the drawing is to denote that the inside of the hollow body 9 is designed as a vacuum chamber 21.

The end of the condensing zone 8 is defined by a nipping roller 22, which is disposed with a delivery nipping line 23 on the hollow body 9, namely on the extension 14. The nipping roller 22 is driven in a way not shown and effects a twist block at the delivery nipping line 23, so that the spinning twist imparted to the thread 24 downstream of the condensing zone 8 does not run back into the condensing zone 8. The thread 24 is guided in delivery direction E to a twisting device, for example, a ring spindle.

The condensing of the fiber strand 7 serves above all to prevent a spinning triangle from occurring at the delivery nipping line 23. The absence of a spinning triangle results in a more even, tear resistant and less hairy thread 24. The fibers of the fiber strand 7 are therefore placed in the condensing zone 8 diagonally to their transport direction, as a result of which the fiber strand 7 is bundled or condensed. For this it is necessary that the fiber strand 7 is disposed on the air-permeable transport belt 16 with its fibers essentially lying parallel to one another.

As the transport belt 16 is permeated by an airflow, it is unavoidable that in the condensing zone 8 a certain amount of fiber fly occurs. This fiber fly can, with time, when nothing is done to counter it, block the perforations of the transport belt 16, which leads to a worsening of the condensing effect with the above mentioned disadvantages. For this reason it is provided according to the present invention to effectively remove fiber fly located on the transport belt 16.

In the inside of the hollow body 9, in addition to the vacuum chamber 21, an additional pressurized chamber 25 is provided, which is denoted by a plus sign in brackets. The pressure here is a relatively low, constant one.

The pressurized chamber 25 has in an area facing away from the suction slit 19 at least one air outlet opening 26 which is directed against the inner side 17 of the transport belt 16. The diameter of the air outlet opening 26 can be less than 1 mm. The required pressurized air feed in arrow direction F is effected by a pressurized air conduit 30 connected to the pressurized chamber 25.

In order that the lowest possible number of air outlet openings is required, this being advantageously one air outlet opening 26, the air outlet opening 26 runs into a hollow space 27, which is located between the outer contour 15 of the hollow body 9 and the inner side 17 of the transport belt 16. The outer contour 15 of the hollow body 9 and the inner side 17 of the transport belt 16 thus form here the lateral borders of the hollow space 27. The contour of the hollow space 27 is here adapted to the outer contour of the bottom cylinder 3, which is disposed at this point on the outer side 18 of the transport belt 16 and which, given its rotational direction A, which is in the opposite direction to the direction of motion of the transport belt 16, carries out an additional mechanical cleaning.

The light pressure in the hollow space 27 removes the fiber fly located at this point of the transport belt 16 and presses it through the perforations, namely to the side facing away from the suction slit 19, out into the free atmosphere, where the fiber fly is no longer detrimental to the spinning process.

The hollow space 27 is closed over at the top by means of a bordering surface 28 of the extension 14. The bordering surface 28 extends to a scraping edge 29 which is disposed closely on the inner side 17 of the transport belt 16, which thus also mechanically cleans the transport belt 16 and at the same time prevents the flow of pressurized air to the suction slit 19.

The occurrence of fiber fly can be prevented to a great extent in the first place in that the distance between the delivery nipping line 23 and the front nipping line 5 of the drafting unit 1 is kept as short as possible and that the beginning of the suction slit 19 is guided as close as is possible to the front nipping line 5. These measures can, in as far as is possible, prevent "swimming" fibers from reaching the condensing zone 8.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. An apparatus for condensing a fiber strand which travels through a condensing zone in an untwisted state after leaving a drafting unit, and in which condensing zone the fiber strand, disposed on an outside of an air-permeable transport belt, is transported over a suction slit which is arranged in a stationary sliding surface which guides an inner side of the transport belt, which sliding surface is formed by an outer contour of a hollow body connected to a vacuum, wherein the hollow body comprises a pressurized chamber which has at least one air outlet opening in an area facing away from the suction slit, said at least one air outlet opening being directed against the inner side of the transport belt.

2. An apparatus according to claim 1, wherein the at least one air outlet opening opens into a hollow space which is defined on one side by the outer contour of the hollow body and on the other side by the inner side of the transport belt.

3. An apparatus according to claim 2, wherein a roller of a front roller pair of the drafting unit is disposed in the area of the hollow space on the outer side of the transport belt.

4. An apparatus according to claim 3, wherein the hollow space is covered in running direction of the transport belt by a bordering area, which bordering area is disposed with a scraping edge close to the inner side of the transport belt.

5. An apparatus according to claim 4, wherein the bordering area is arranged at an extension comprising the suction slit, which extension, together with a hollow profile connected to a vacuum source, forms the hollow body.

6. An apparatus according to claim 3, wherein the hollow space is connected to the atmosphere in an opposite direction to the running direction of the transport belt.

7. An apparatus according to claim 2, wherein the hollow space is covered in running direction of the transport belt by bordering area, which bordering area is disposed with a scraping edge close to the inner side of the transport belt.

8. An apparatus according to claim 7, wherein the bordering area is arranged at an extension comprising the suction slit, which extension, together with a hollow profile connected to a vacuum source, forms the hollow body.

9. An apparatus according to claim 8, wherein the hollow space is connected to the atmosphere in an opposite direction to the running direction of the transport belt.

10. An apparatus according to claim 7, wherein the hollow space is connected to the atmosphere in an opposite direction to the running direction of the transport belt.

11. An apparatus according to claim 2, wherein the hollow space is connected to the atmosphere in an opposite direction to the running direction of the transport belt.

* * * * *